US005904274A

United States Patent [19]

Warby et al.

[11] Patent Number: 5,904,274

[45] Date of Patent: May 18, 1999

[54] METERING VALVE

[75] Inventors: Richard John Warby, Wisbech; Anthony Gary Stanford, King's Lynn, both of United Kingdom

[73] Assignee: Bespak, plc, Norfolk, United Kingdom

[21] Appl. No.: 08/915,575

[22] Filed: Aug. 21, 1997

[30] Foreign Application Priority Data

Sep. 3, 1996 [GB] United Kingdom ..... 9618348

[51] Int. Cl.[6] ..... B65D 83/00

[52] U.S. Cl. ..... 222/402.2

[58] Field of Search ..... 222/402.2, 394, 222/402.24, 402.19

[56] References Cited

U.S. PATENT DOCUMENTS

| | | | |
|---|---|---|---|
| 2,812,884 | 11/1957 | Ward | 222/402.2 |
| 3,235,135 | 2/1966 | Robert et al. | 222/402.2 |
| 4,811,868 | 3/1989 | Nitta | 222/402.2 |
| 5,037,013 | 8/1991 | Howlett | 222/402.2 |
| 5,632,421 | 5/1997 | Colombo | 222/402.2 |

FOREIGN PATENT DOCUMENTS 2178398 7/1985 United Kingdom .

2298187 2/1995 United Kingdom .

*Primary Examiner*—Andres Kashinkow
*Assistant Examiner*—Keats Quinalty
*Attorney, Agent, or Firm*—Smith, Gambrell & Russell, LLP; Beveridge, DeGrandi, Weilacher & Young Intellectual Property Group

[57] ABSTRACT

A metering valve for use in a pressurized dispensing container has a valve member co-axially slidable within an annular metering chamber defined between the valve member and a substantially cylindrical chamber body. The chamber volume is between 50 and 100 micro liters. The metering valve has an outer seal operable between the valve member and an outer end portion of the chamber body to seal an outlet duct of the valve member when the valve member is in an inoperative position. The valve member is slidable to an operative position in which the contents of the metering chamber are dischargeable in use via the outlet duct. The outer end portion of the chamber body comprises a first inwardly stepped shoulder, a lip having an inner surface which slopes outwardly away from the peripheral edge of the outer seal, and a second inwardly stepped-shoulder. An annular seal support associated with the outer seal has a periphery which is supported by the second shoulder. Axial compression of the outer seal causes it to deform into sealing contact with the shoulder and the inner surface of the lip, the resulting seal having radial and transverse elements.

1 Claim, 2 Drawing Sheets

METERING VALVE

This invention relates to metering valves for pressurised dispensing containers.

Pressurised dispensing containers are typically used to dispense products in aerosol form using a propellant which is volatile at normal temperature and pressure, the product to be dispensed being mixed with liquid propellant which remains in liquid phase by virtue of excess vapour pressure within the container. Metering valves are utilised to dispense measured volumes of this liquid and comprise a metering chamber with inlet and outlet valves controlled by displacement of a valve member which defines an outlet duct.

Operation of the metering valve requires the chamber to be filled via the inlet valve, the inlet valve then closed and the outlet valve opened such that the contents are expelled by boiling off propellant in response to the chamber being vented to atmospheric pressure.

The present invention is concerned with improving the performance of the outlet valve which comprises an outer seal maintaining sliding contact with the valve member.

According to the present invention there is disclosed a metering valve for use in a pressurised dispensing container, the metering valve comprising a valve member co-axially slidable within an annular metering chamber defined between the valve member and a substantially cylindrical chamber body, the metering valve further comprising an outer seal operable between the valve member and an outer end portion of the chamber body to seal an outlet duct of the valve member when the valve member is in an inoperative position, the valve member being slidable to an operative position in which the contents of the metering chamber are dischargeable in use via the outlet duct, and wherein the outer end portion of the chamber body comprises an inwardly stepped shoulder and a lip having an inner surface which slopes outwardly away from the peripheral edge of the outer seal, the periphery of the outer seal being supported by the said shoulder, such that axial compression of the outer seal causes it to deform into sealing contact with the shoulder and the inner surface of the lip, the resulting seal having radial and transverse elements.

An advantage of such an arrangement is to provide an effective seal to improve leakage resistance due to any axial deformation in use which would tend to distort the outer seal away from its normal radial sealing position relative to the valve member.

A preferred embodiment of the present invention will now be described with reference to the accompanying drawings of which:

Figure 1:
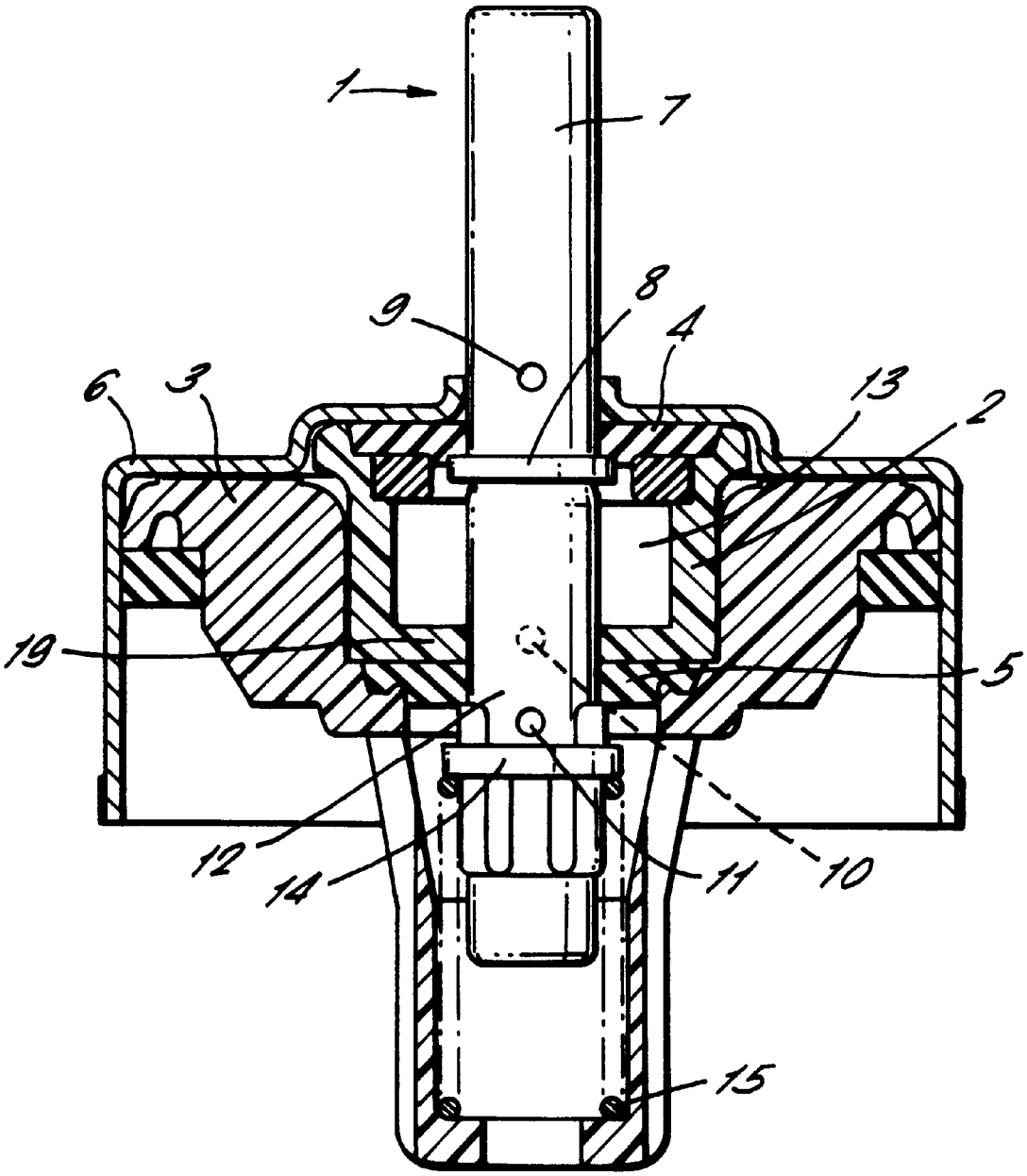
FIG. 1 is a sectional elevation of a prior art metering valve.

The metering valve of FIG. 1 comprises a valve member 1 which is axially slidable within an annular chamber body 2 mounted co-axially within a valve housing 3.

An outer seal 4 and an inner seal 5 of elastomeric material extend radially between the valve member 1 and the chamber body 2.

(Throughout the description, unless otherwise indicated, the terms inner and outer indicate relative positions along the axis of the metering valve such that "inner" implies proximal to the container and "outer" implies distal with respect of the container.)

The outer seal 4 is radially compressed between the chamber body 2 and the valve member 1 so as to provide positive sealing contact, the compression being achieved by dimensioning the outer seal such that it is an interference fit on the valve member 1 or by axially compressing the outer seal by crimping onto a container (not shown) a ferrule 6 which secures together the valve housing 3, the chamber body 2 and the outer seal 4 during assembly.

An upper end portion 7 of the valve member 1 is tubular and hollow but closed internally at a location corresponding to an external radially projecting flange 8. A discharge port 9 is defined in the upper end portion 7 at a location immediately above the flange 8 so as to extend radially into communication with the interior of the upper end portion.

Also formed in the valve member 1 is an inlet passage comprising a pair of axially spaced radial ports 10 and 11 which are interconnected through a central cavity 12 within the valve member.

An annular metering chamber 13 is enclosed between the chamber body 2 and the valve member 1 and is normally sealed from the atmosphere by the outer seal 4 when the valve member 1 is in its inoperative position (as shown in FIG. 1). In the configuration shown in FIG. 1, the radial ports 10 and 11 together with the central cavity 12 connect the metering chamber 13 with the interior of the container so that the metering chamber 13 would in this configuration be filled with fluid material to be dispensed when the container and valve are held in an inverted position in which the valve member 1 is lowermost.

Upon depression of the valve member 1 relative to the valve housing 3, the radial port 10 becomes sealed by the inner seal 5 so that the metering chamber 13 is isolated from the interior of the pressurised container. Upon further depression of the valve member 1 into its operative position, the discharge port 9 moves into a position in which it communicates between the metering chamber 13 and the hollow interior of the upper end portion 7 of the valve member thereby constituting an outlet duct such that the pressurised material within the metering chamber 13 is discharged to the atmosphere by virtue of the rapid expansion of volatile propellant on being exposed to atmospheric pressure. Upon returning the valve member 1 to its inoperative position as shown in FIG. 1, the metering chamber 13 becomes recharged in readiness for further dispensing operations.

A return spring 15 extends in compression between the valve housing 3 and a second flange 14 of the valve member, the bias provided by the spring being operable to hold the flange 8 in sealing contact with the outer seal 4.

A problem associated with such prior art arrangements in metering valves for pressurised dispensers is that the outer seal 4 tends to deform by distending axially so that the radial contact pressure between the outer seal 4 and the chamber body 2 is diminished with consequent loss of sealing effectiveness.

This problem is overcome in accordance with the present invention by modifying the chamber body 2 to create a surface on the chamber body 2 to which the upper seal 4 can seal against in a transverse direction.

Figure 2:
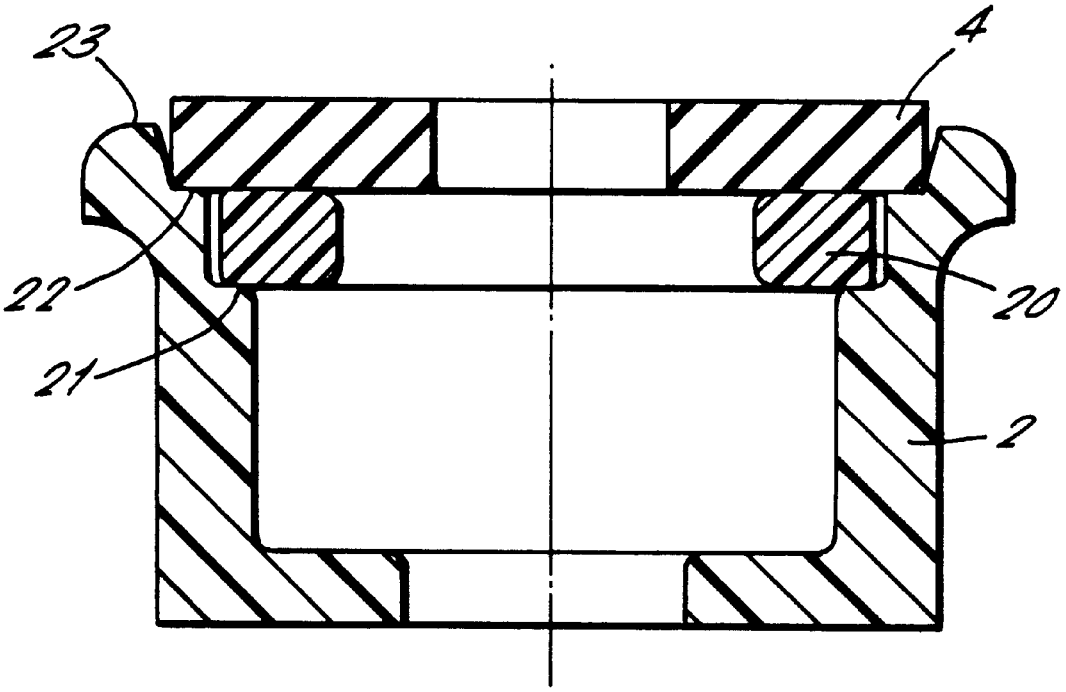
FIG. 2 is a sectional elevation of a chamber body and seal for the metering valve of the present invention.

As can be seen in FIG. 2, an annular seal support 20 is supported at its periphery by an first inwardly stepped shoulder 21 at an upper end of the chamber body 2. The seal support 20 is preferably of a material such as acetal copolymer. The upper seal 4 rests on the support 20 and is further supported at its periphery by a second inwardly stepped shoulder 22 of the chamber body 2.

The chamber body 2 is also provided with an annular lip 23, the inner surface of which slopes gently upwards from the stepped shoulder 22 and outwards away from the peripheral edge of the upper seal 4 in a non-compressed condition.

When the ferrule 6 is crimped to the container the upper seal 4 deforms both radially and transversely to substantially fill the gap between the lip 23 and the peripheral edge of the seal 4, which is substantially triangular in cross-section. Thus the seal between the chamber body 2 and the upper seal 4 has both radial and tranverse elements, the latter providing a significantly improved seal over the known prior art seals.

The present invention has particular application to pharmaceutical metering valves in which the volume of the metering chamber 13 is typically of the order of 50 to 100 micro liters.

We claim:

1. A metering valve for use in a pressurized dispensing container, the metering valve comprising a valve member co-axially slidable within an annular metering chamber of volume between 50 and 100 micro liters defined between the valve member and a substantially cylindrical chamber body, the metering valve further comprising an outer seal operable between the valve member and an outer end portion of the chamber body to seal an outlet duct of the valve member when the valve member is in an inoperative position, the valve member being slidable to an operative position in which the contents of the metering chamber are dischargeable in use via the outlet duct, and wherein the outer end portion of the chamber body comprises a first inwardly stepped shoulder and a lip having an inner surface which slopes outwardly away from the peripheral edge of the outer seal, said chamber body having a second inwardly stepped shoulder, the periphery of the outer seal being supported by said first shoulder, the metering valve further comprising an annular seal support having a periphery which is supported by said second inwardly stepped shoulder of the chamber body, such that axial compression of the outer seal causes it to deform into sealing contact with the first shoulder and the inner surface of the lip, the resulting seal having radial and transverse elements.

* * * * *